US009637947B2

(12) United States Patent
LeMoine et al.

(10) Patent No.: US 9,637,947 B2
(45) Date of Patent: May 2, 2017

(54) ERECTABLE SHELTER STRUCTURES AND METHODS OF ASSEMBLY AND DISASSEMBLY

(71) Applicant: ShelterLogic Corp., Watertown, CT (US)

(72) Inventors: George LeMoine, Trumbull, CT (US); Joseph Crute, Cromwell, CT (US)

(73) Assignee: ShelterLogic Corp., Watertown, CT (US)

( * ) Notice: Subject to any disclaimer, the term of this patent is extended or adjusted under 35 U.S.C. 154(b) by 0 days.

(21) Appl. No.: 14/545,986

(22) Filed: Jul. 13, 2015

(65) Prior Publication Data

US 2016/0076272 A1 Mar. 17, 2016

Related U.S. Application Data

(60) Provisional application No. 62/050,341, filed on Sep. 15, 2014, provisional application No. 62/050,332, filed on Sep. 15, 2014.

(51) Int. Cl.
*E04H 15/48* (2006.01)

(52) U.S. Cl.
CPC ..... *E04H 15/48* (2013.01)

(58) Field of Classification Search
CPC ..... E04H 15/48; E04H 15/32
USPC ..... 135/143, 153, 120.3
See application file for complete search history.

(56) References Cited

U.S. PATENT DOCUMENTS

| | | | | | |
|---|---|---|---|---|---|
| 1,504,889 | A * | 8/1924 | Hansen | E04H 15/48 | 135/153 |
| 2,797,696 | A * | 7/1957 | Fritsche | E04H 15/38 | 135/117 |
| 3,636,676 | A | 1/1972 | Moss | | |
| 4,066,089 | A | 1/1978 | Rainwater | | |
| 4,347,690 | A * | 9/1982 | Wallace, Jr. | E04B 1/34326 | 135/160 |
| 4,667,692 | A * | 5/1987 | Tury | E04H 15/18 | 135/139 |
| 5,069,238 | A * | 12/1991 | Marks | E04H 15/48 | 135/153 |
| 5,167,246 | A | 12/1992 | Mortenson | | |

(Continued)

FOREIGN PATENT DOCUMENTS

| | | | | |
|---|---|---|---|---|
| GB | 884378 | | 12/1961 | |
| GB | 2200152 | A * | 7/1988 | E04H 15/48 |
| WO | WO9512045 | A1 * | 5/1995 | E04H 15/48 |

OTHER PUBLICATIONS

"Manual Clamps" De-Sta-Co; De-Sta- Co Clamps—How Toggle Action Works (2 pages) (Admitted Prior Art).

(Continued)

*Primary Examiner* — Noah Chandler Hawk
(74) *Attorney, Agent, or Firm* — Carmody Torrance Sandak & Hennessey LLP

(57) ABSTRACT

Erectable shelter frame structures including a plurality of rib assemblies. Preferably, each rib assembly has a receptacle for receiving a respective end of a purlin arrangement, the other end of which is attached to a receptacle of a subsequent rib assembly. The joints include toggle clamps that assist in facilitating the ease by which the shelter structure can be assembled or disassembled. Methods of construction and disassembly of the shelter frame structure are also disclosed.

9 Claims, 7 Drawing Sheets

(56) References Cited

U.S. PATENT DOCUMENTS

| | | | | |
|---|---|---|---|---|
| 5,263,507 | A * | 11/1993 | Chuang | E04H 15/46 135/140 |
| 5,584,311 | A * | 12/1996 | Schaefer | E04H 15/34 135/120.3 |
| 7,584,763 | B2 | 9/2009 | Yoon | |
| 7,621,289 | B2 * | 11/2009 | Ju | E04H 15/48 135/120.3 |
| 2008/0029143 | A1 * | 2/2008 | Yoon | E04H 15/505 135/128 |
| 2011/0284044 | A1 * | 11/2011 | Baldussi | E04H 15/48 135/124 |
| 2013/0206197 | A1 * | 8/2013 | Hotes | E04H 15/18 135/96 |
| 2013/0312799 | A1 * | 11/2013 | Hotes | E04H 15/48 135/93 |

OTHER PUBLICATIONS

"Toggle Action Force Factors" Steelsmith Clamps; Toggle_action_force_factors ~ Steelsmith Clamps (3 pages) (Admitted Prior Art).

* cited by examiner

ERECTABLE SHELTER STRUCTURES AND METHODS OF ASSEMBLY AND DISASSEMBLY

This application claims the benefit of U.S. application Ser. Nos. 62/050,332 and 62/050,341, both filed on Sep. 15, 2014. The subject matter of both of said provisional applications are incorporated by reference as if fully set forth herein.

BACKGROUND OF THE INVENTION

The present invention is generally directed to erectable shelter structures, and in particular, to improved erectable shelter structure constructions and improved methods for assembly and disassembly thereof.

Shelter structures that are self-described as rapidly erectable are well known. One example thereof can be seen in U.S. Pat. No. 5,167,246. Other collapsible shelter structures are also known, such as those described in U.S. Pat. No. 4,066,089. While such constructions may be described as quick to erect and/or disassemble, such constructions still suffer from perceived deficiencies.

The present inventors have set out to overcome such perceived deficiencies. For example, generally speaking, known structural frame buildings comprised of joined rib structures may have hinged joints to fold for storage and assembly, with such structures being joined by cross members (e.g. purlins) that are coupled to the folding rib structures.

However, the current prior art designs include constructions where the purlins and other cross rail assemblies may be already preassembled and attached to the rib assemblies, thus adding weight and difficultly to the construction. Such known prior art examples also thus reduce the ease of handling during assembly and disassembly of the shelter structure.

Another perceived deficiency in the known prior art is that the rib structures are typically dedicated to the end ribs such that the purlins are only attachable to one side of the rib assembly. Thus, known structures do not readily lend themselves to modularity of increased and decreased size for easily meeting a user's needs and desires.

Also known in the prior art is a top double pivot design as exemplified in U.S. Pat. No. 3,826,270. Such a design heretofore has been required to permit components of the rib assembly to become parallel when collapsed, so as to minimize the size and configuration of the rib assemblies for ease of handling and storage. However, because the extra components required to achieve the double pivot add cost and complexity to the rib assembly, it is less than optimal of a design. Moreover, the second pivot at the top joint can create instability while unfolding the rib unless a mechanism is added to maintain positional stability during the folding and unfolding thereof. Such an additional mechanism also adds cost and complexity to the joint design.

The present invention sets out to overcome such perceived deficiencies. For example and not limitation, the present invention allows for the easier transportation of structure components, the easier assembly and disassembly of the structure and the easier storage thereof.

More specifically, it is believed that further advances to the state of the art are both desirable and achievable. In particular, it is desirable to provide improved shelter structures that are easier to assemble and disassemble than prior art designs and which are also lighter in weight and less costly to construct than prior art designs, all the while providing needed and even improved functionality and structural integrity over known prior art designs. It is also desirable to provide methodologies for erecting and disassembling such shelter structures.

SUMMARY AND OBJECTIVES OF THE INVENTION

It is thus an objective of the present invention to overcome the perceived deficiencies in the prior art.

Specifically, it is an objective of the present invention to provide an improved rib assembly that provides folding elements at or near the peak of the structure and at or near the eave bends of the structure, allowing the rib structure to be folded for storage and providing for less time to assemble and dismantle.

Another objective of the present invention to provide an improved rib assembly that provides spacing, creating an increased enclosed volume of the frame of the shelter structure.

Yet another objective of the present invention to provide improved methods of construction of the shelter structure and improved methods and constructions of attaching the cross members to the rib assemblies.

Still another objective of the present invention to provide an improved rib assembly that provides for improved folding capabilities to achieve improved surfaces for the cover to be attached thereto.

Still further, an objective of the present invention to provide an improved rib assembly that provides for the rib assemblies to fold inward while using a minimum number of joints, as opposed to prior art constructions that require two joints near the peak, thus reducing the weight and construction costs thereof, while also improving the structural integrity and ease of construction and disassembly thereof.

Still further, an objective of the present invention to provide an improved shelter structure design that is easier and quicker to construct than heretofore known in the art.

Therefore, in accordance with a preferred embodiment, the present invention is directed to an erectable shelter frame structure comprising at least a first rib assembly and an Nth rib assembly, wherein each of the first rib assembly and the Nth rib assembly comprises a peak joint assembly, a first side joint assembly and a second side joint assembly, a first arch rail arrangement intermediate the peak joint assembly and the first side joint assembly, a second arch rail arrangement intermediate the peak joint assembly and the second side joint assembly, a first leg arrangement coupled to the first side joint assembly, and a second leg arrangement coupled to the second side joint assembly, wherein with respect to the first end rib assembly: the peak joint assembly comprises a receptacle for receiving a first end of a first purlin arrangement, the first side joint assembly comprises a receptacle for receiving a first end of a second purlin arrangement, and the second side joint assembly comprises a receptacle for receiving a first end of a third purlin arrangement, wherein with respect to the Nth rib assembly: the peak joint assembly comprises a receptacle in facing alignment with the peak joint assembly receptacle of the first rib assembly that receives the first end of the first purlin arrangement, for receiving a second end of a first purlin arrangement; the first side joint assembly comprises at least a receptacle in facing alignment with the first side joint assembly receptacle of the first rib assembly that receives the first end of the second purlin arrangement, for receiving a second end of the second purlin arrangement; and the second side joint assembly comprises a receptacle in facing alignment with the second side joint assembly receptacle of the first rib assembly that receives the first end of the third purlin arrangement, for receiving a second end of the third purlin arrangement; wherein for each of the first end rib assembly and the Nth rib assemblies, the first arch rail arrangement and the second arch rail arrangement are rotatable with respect to each other about the respective peak joint assemblies, the first leg arrangement and the first arch rail arrangement are rotatable with respect to each other about the respective first side joint assemblies, and the second leg arrangement and the second arch rail arrangement are rotatable with respect to each other about the respective second side joint assemblies.

In another preferred embodiment, the present invention is directed an erectable shelter frame structure comprising a first rib assembly and at least a second rib assembly, wherein each of the first rib assembly and the second rib assembly comprises a peak joint assembly, a first side joint assembly and a second side joint assembly, and wherein the peak joint assembly, the first side joint assembly and the second side joint assembly are all at least essentially identical in construction; a plurality of purlin arrangements to couple the first rib assembly to the second rib assembly and thereby form a shelter structure; wherein each of the first and second rib assemblies comprises: a non-linear first arch rail arrangement intermediate the peak joint assembly and the first side joint assembly; a non-linear second arch rail arrangement intermediate the peak joint assembly and the second side joint assembly, a first leg arrangement coupled to the first side joint assembly, and a second leg arrangement coupled to the second side joint assembly; and each is foldable such that in a folded state: the first and second leg arrangements are parallelly aligned and positioned intermediate the first arch rail arrangement and the second arch rail arrangement.

In yet another preferred embodiment, the present invention is directed an erectable shelter frame structure comprising at least a first rib assembly and an Nth rib assembly, wherein each of the first rib assembly and the Nth rib assembly comprises a peak joint toggle clamp, a first side joint toggle clamp and a second side joint toggle clamp; a plurality of purlin arrangements to couple the first rib assembly to the Nth rib assembly to thereby form a shelter structure; wherein at least the first side joint toggle clamp and the second side joint toggle clamp are at least essentially identical in construction; and wherein each of the rib assemblies comprise a first arch rail arrangement intermediate the peak joint toggle clamp and the first side joint toggle clamp, a second arch rail arrangement intermediate the peak joint toggle clamp and the second side joint toggle clamp, a first leg arrangement coupled to the first side joint toggle clamp, and a second leg arrangement coupled to the second side joint toggle clamp.

In yet another preferred embodiment, the present invention is directed a method of at least one of assembling and disassembling a shelter frame structure, wherein the shelter frame structure comprises at least a first rib assembly and a second rib assembly, wherein each of the first rib assembly and the second rib assembly comprises a peak joint assembly, a first side joint assembly and a second side joint assembly, a first arch rail arrangement intermediate the peak joint assembly and the first side joint assembly, a second arch rail arrangement intermediate the peak joint assembly and the second side joint assembly, a first leg arrangement coupled to the first side joint assembly, and a second leg arrangement coupled to the second side joint assembly, wherein with respect to the first end rib assembly the peak joint assembly comprises a receptacle for receiving a first end of a first purlin arrangement, the first side joint assembly comprises a receptacle for receiving a first end of a second purlin arrangement, and the second side joint assembly comprises a receptacle for receiving a first end of a third purlin arrangement, wherein with respect to the second rib assembly, the peak joint assembly comprises a receptacle in facing alignment with the peak joint assembly receptacle of the first rib assembly that receives the first end of the first purlin arrangement, for receiving a second end of a first purlin arrangement; the first side joint assembly comprises at least a receptacle in facing alignment with the first side joint assembly receptacle of the first rib assembly that receives the first end of the second purlin arrangement, for receiving a second end of the second purlin arrangement; and the second side joint assembly comprises a receptacle in facing alignment with the second side joint assembly receptacle of the first rib assembly that receives the first end of the third purlin arrangement, for receiving a second end of the third purlin arrangement; wherein for each of the first end rib assembly and the second rib assemblies, the first arch rail arrangement and the second arch rail arrangement are rotatable with respect to each other about the respective peak joint assemblies, the first leg arrangement and the first arch rail arrangement are rotatable with respect to each other about the respective first side joint assemblies, and the second leg arrangement and the second arch rail arrangement are rotatable with respect to each other about the respective second side joint assemblies, and wherein each of the peak joint assemblies, the first side joint assemblies and the second side joint assemblies comprise a respective toggle clamp; wherein the method comprises the steps of: unfolding the first rib assembly so that a base of the first leg arrangement is in facing alignment with a base of the second leg arrangement; coupling the first end of the first purlin arrangement to the receptacle associated with the peak joint assembly, coupling the first end of the second purlin arrangement to the receptacle associated with the first side joint assembly and coupling the first end of the third purlin arrangement to the receptacle associated with the second side joint assembly; unfolding the second rib assembly so that a base of the first leg arrangement is in facing alignment with a base of the second leg arrangement; coupling the second end of the first purlin arrangement to the receptacle associated with the peak joint assembly of the second rib assembly, coupling the second end of the second purlin arrangement to the receptacle associated with the first side joint assembly of the second rib assembly and coupling the second end of the third purlin arrangement to the receptacle associated with the second side joint assembly of the second rib assembly, rotating the first leg arrangement of the respective first and second rib assemblies and locking the respective toggle clamps associated with each respective first side joint assembly of the first and second rib assemblies; rotating the second leg arrangement of the respective first and second rib assemblies and locking the respective toggle clamps associated with each respective second side joint assembly of the first and second rib assemblies.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

BRIEF DESCRIPTION OF THE DRAWINGS

The above set forth and other features of the invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DETAILED DESCRIPTION OF THE PREFERRED EMBODIMENTS

Reference will now be made generally to the figures for a brief overview of the preferred embodiments of the present invention.

Generally speaking, in accordance with preferred embodiments of the present invention, the folding rib assemblies may be constructed as end assemblies or intermediate rib assemblies, which can be joined to purlins on both sides and intermediate to the end rib assemblies. Purlin attachments can be such and receptacles positioned so that the rib sections can be used as end or intermediate rib assemblies.

Figure 1B:
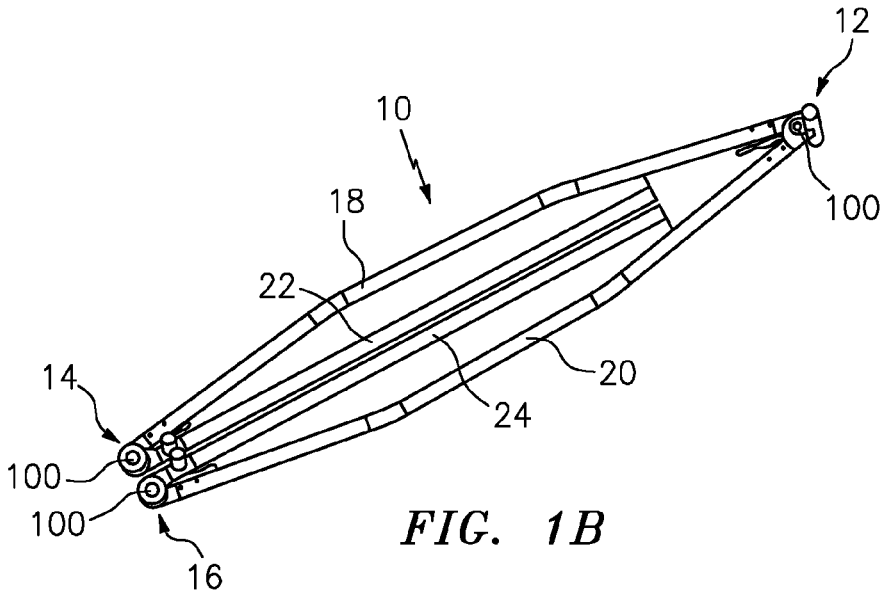
FIGS. 1A and 1B illustrate different shaped rib assemblies constructed in accordance with preferred embodiments of the present invention.
Figure 1A:
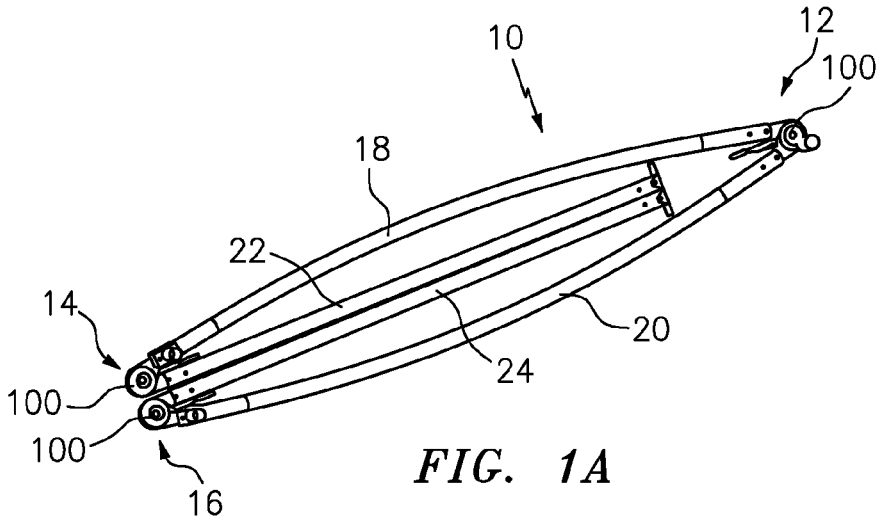

Generally speaking, FIGS. 1A and 1B illustrate two preferred embodiments of a rib assembly, generally indicated at 10, constructed in accordance with the present invention. Reference to one of FIGS. 1A and 1B shall be deemed to equally apply to the other. Likewise, while the figures generally are consistently illustrated with respect to FIG. 1A designed rib assemblies, all the figures are equally applicable as if rib assemblies as illustrated in FIG. 1B were shown. It should also be understood, even if not explicitly mentioned, that all rib assemblies in any particular shelter structure disclosed or envisioned herein are preferably identically constructed. However, differing shaped shelter structures may be formed using the differently shaped rib assemblies, as illustrated, but not limited, in FIGS. 1A and 1B.

Figure 8:
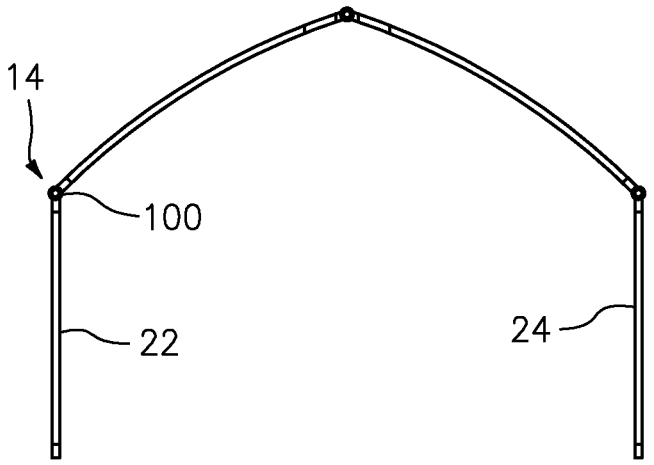
FIG. 8 is a front view of a fully opened rib assembly.
Figure 10:
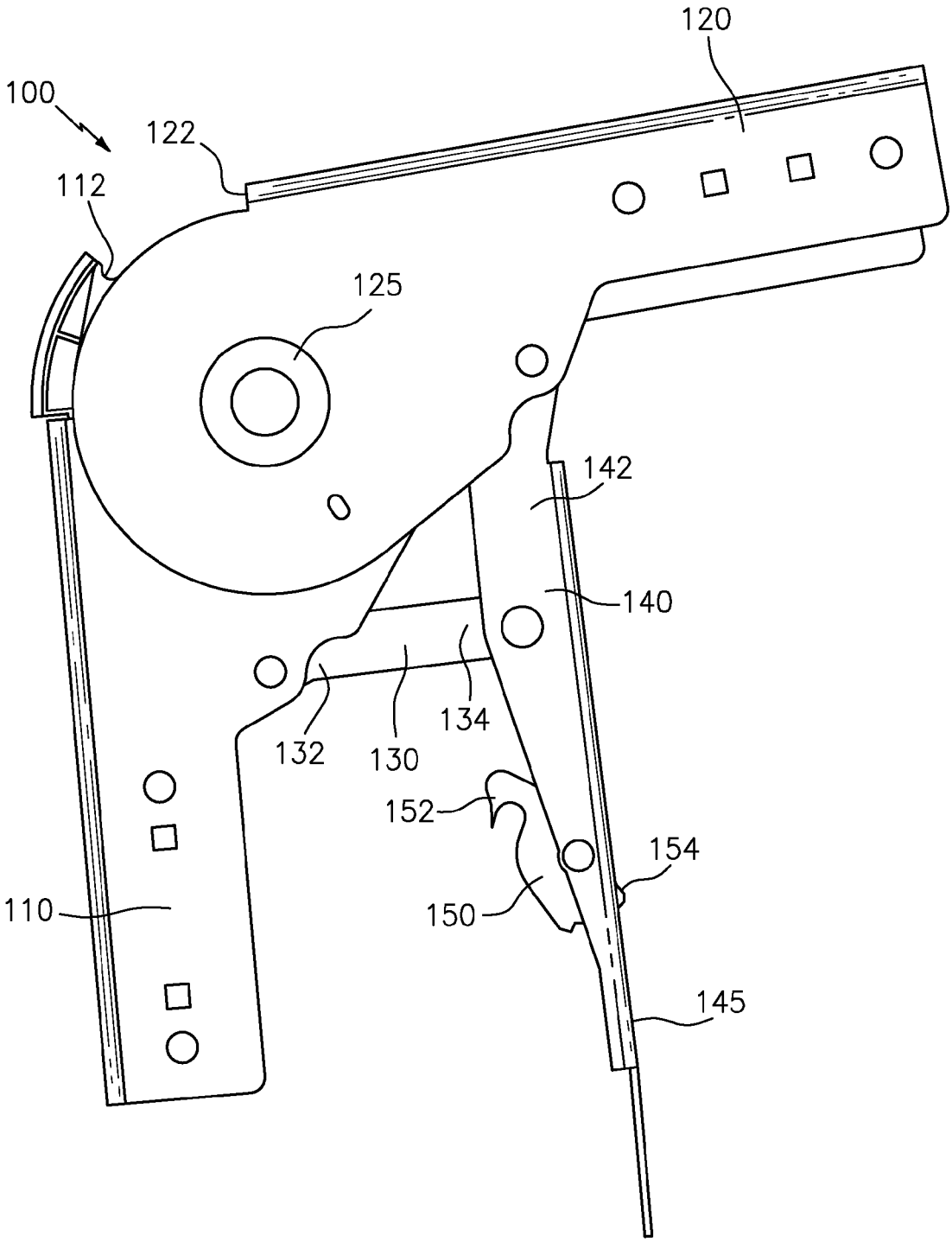
FIG. 10 illustrates a toggle clamp in accordance with a preferred embodiment of the present invention.
Figure 12:
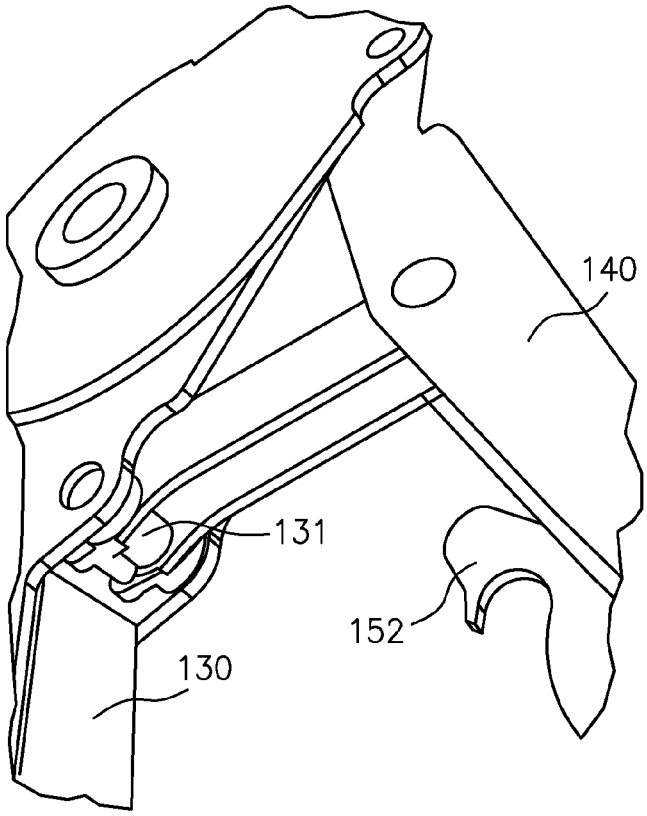
FIGS. 11 and 12 illustrate various specific features of the toggle clamp illustrated in FIG. 10.

Most generally, FIGS. 1A and 1B illustrate the preferred rib assembly constructions in a fully folded position. FIG. 8 illustrates an exemplary rib assembly 10 in a fully open position.

Figure 2:
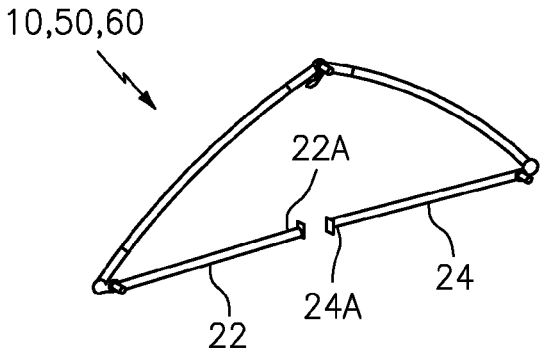
FIG. 2 illustrates the exemplary rib assembly in FIG. 1A (but also applicable to the assembly in FIG. 1B) in accordance with a preferred embodiment shown in a partially unfolded position.

In accordance with a preferred method of constructing a shelter structure, the first rib assembly 10 may be unfolded at the peak and stood up on the eave joints, as illustrated in FIG. 2. In this position, it can be seen that a base 22*a* of the first leg arrangement 22 is in facing alignment with a base 24*a* of the second leg arrangement 24;

The pivoting joint assembly located at the peak may then be secured or latched as will be discussed below.

Figure 3:
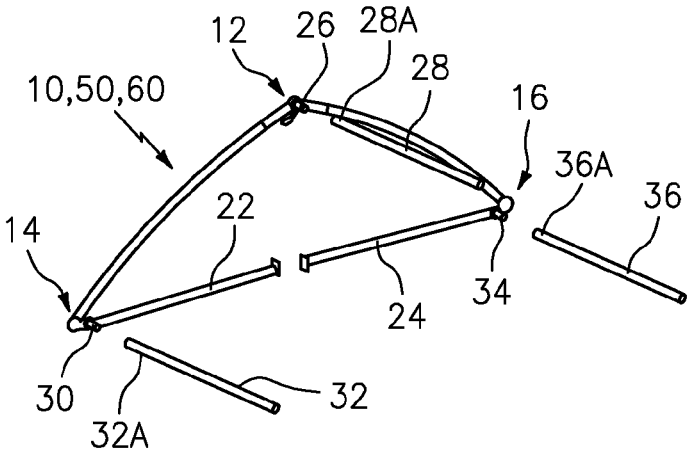
FIG. 3 illustrates the rib assembly of FIG. 2 being coupled to purlin arrangements.
Figure 4:
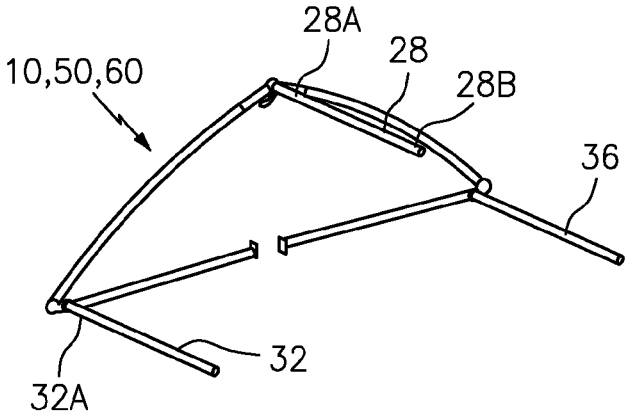
FIG. 4 illustrates the purlin arrangements of FIG. 3 having been coupled to the rib assembly of FIG. 3.

As illustrated in FIG. 3, the purlin arrangements may then be installed in the respective receptacles. The purlins can be locked into position or left to move freely within the receptacle. As illustrated in FIG. 4, rib assembly 10 may be complete with the purlins located in the respective receptacles thereof.

Figure 5:
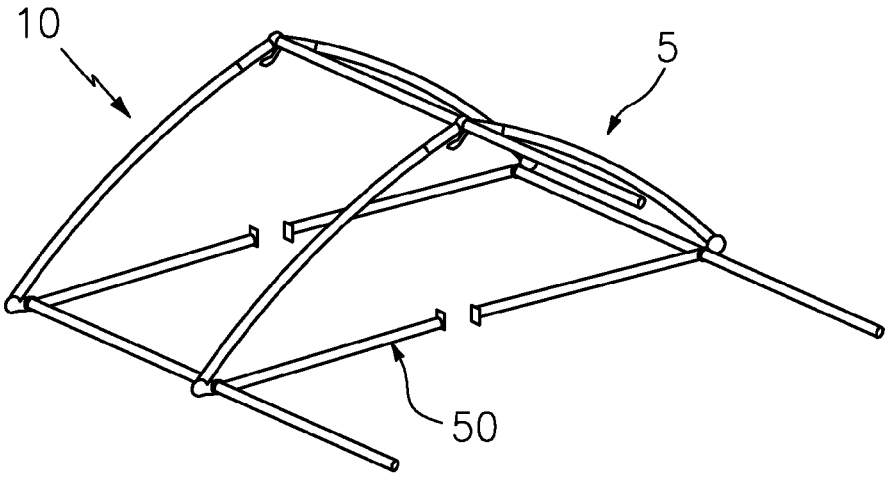
FIG. 5 illustrates a second rib assembly such as that illustrated in FIGS. 1A, 1B in accordance with a preferred embodiment being coupled to a first rib assembly.

As next shown in FIG. 5, a next folded rib assembly, generally indicated at 50, may be unfolded and secured to the first rib assembly 10, preferably by coupling the respective peak pivot joint assemblies by a purlin arrangement. The rib assembly 50 is then attached to the remaining purlins installed into the first rib assembly 10. The next sets of purlin arrangements may be installed into the receptacles of the successive rib assemblies as described above. It should be noted that the purlins are preferably assembled into next rib assemblies and so on to create shelter structure 5. This process can be continued for additional rib assemblies and completed in any order until all of the required components of rib assemblies and purlin arrangements are completed.

Figure 6:
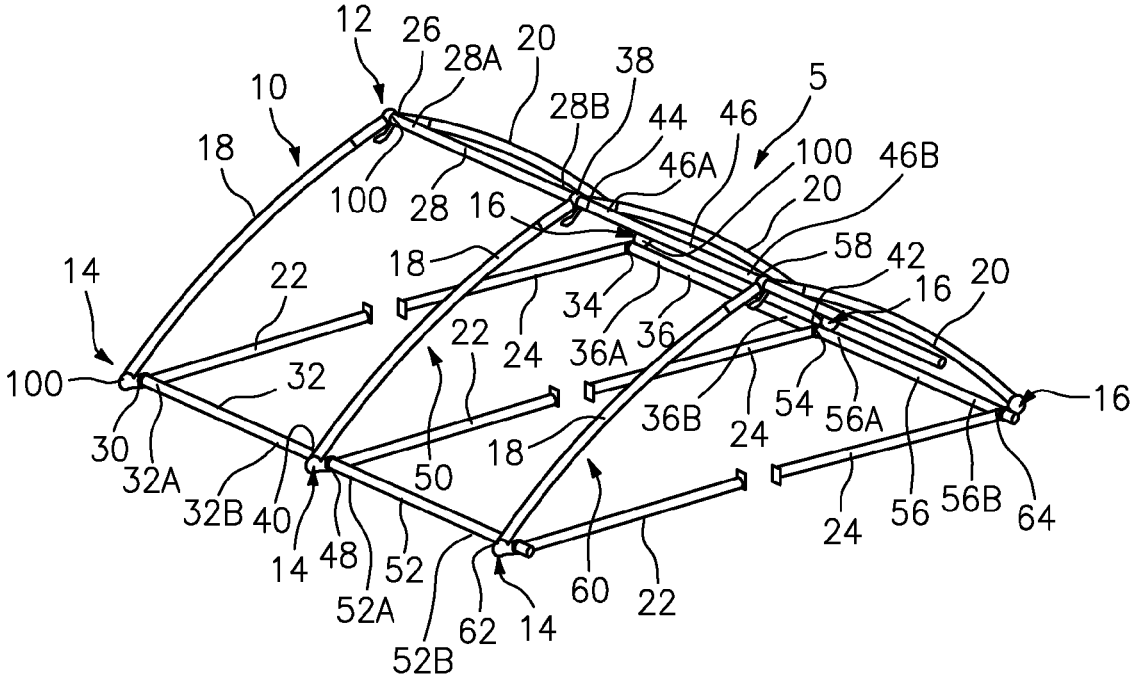
FIG. 6 illustrates yet a third rib assembly in accordance with a preferred embodiment being coupled to the first and second rib assemblies thereby forming a shelter structure larger than would be formed using only two rib assemblies.

As a particular example, FIGS. 5 and 6 illustrate a shelter structure being assembled with more than two (2) rib assemblies. In particular, FIG. 6 shows a shelter structure with three (3) rib assemblies. However, it should be understood that any number of rib assemblies may be used and, as disclosed above, such versatility in shelter size is an objective and advantage of the present invention. For purposes of supporting the claims, it is preferable that the number of rib assemblies be at least two (2) and preferably no more than five (5), but this is only limited by the desires and needed functionality and shelter by any user(s) thereof. For purposes of supporting the claims, N shall be equal to or less than 10.

Figure 9A:
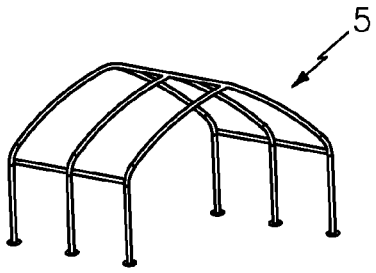
FIG. 9A shows a completed and fully erected shelter structure with three (3) rib assemblies and FIG. 9B shows such an erected structure having been covered.
Figure 9B:
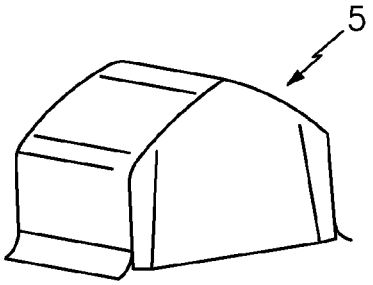

Once all the ribs and purlin arrangements are installed, to complete the shelter structure assembly of the desired size, it is preferable to place the cover(s) (see FIG. 9B) over the assembled frame (e.g. see FIG. 9A) prior to lifting the frame. If the cover is one piece, the cover may be installed over the fully assembled frame structure. If the cover is comprised of multiple sections, such as end panels and top panels, the intermediate rib sections might be covered first. End panels may be installed with the end ribs as part of the frame assembly. The top cover may be laid over the top of the structure prior to the next steps.

Figure 7:
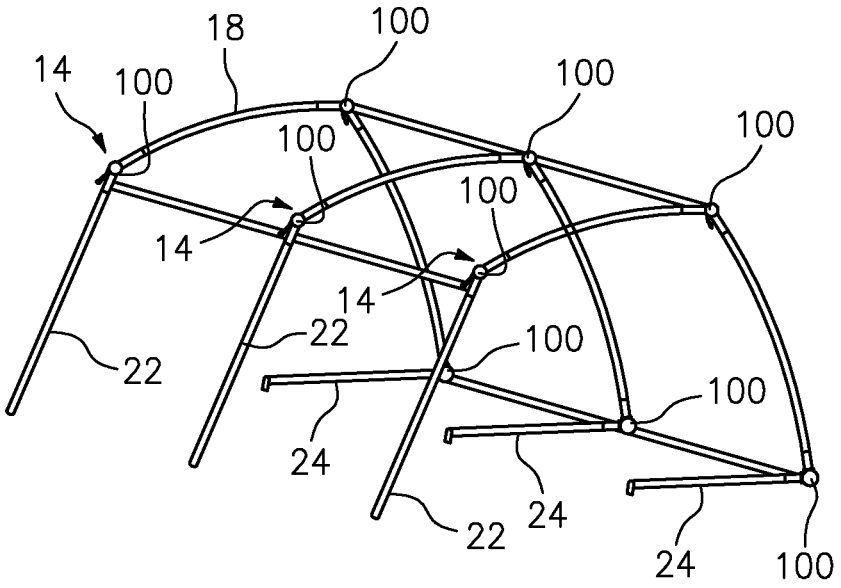
FIG. 7 illustrates the shelter structure of FIG. 6 with the legs of one side having been lifted and prepared for full erecting.

For example, for illustrative purposes, reference is made to FIG. 7, which shows the structure without any covers. This is for exemplary purposes, since the cover(s) may be put on the structure prior to lifting as now will be explained, or after lifting, as desired. As illustrated in FIG. 7, one side of the shelter structure 5 may then be lifted and the leg arrangements (e.g. leg arrangements 22) are pulled out to their final assembled position, the pivoting joint assemblies (e.g. preferably toggle clamps, as further disclosed below)

on the opened leg arrangements 22 then being locked or maintained in the open position as disclosed below. The lower side (e.g. leg arrangements 24) is then preferably elevated into the open position (e.g. FIG. 8). The pivot joint assemblies (e.g. toggle clamps) of the eaves can be latched or maintained in the open position (FIG. 8) as discussed below. Once the leg arrangements are opened the pivot joints are locked if not done so in the previous steps. Once erect, the cover installation can be completed if not done so in the previous steps, as alluded to above. Cover attachment and anchoring can then be finalized.

With an overall disclosure of the invention, a more detailed disclosure of a rib assembly and shelter structure constructed in accordance with preferred embodiments of the present invention will now be provided.

As noted above, creating a compact assembly when collapsing the structure can be achieved using a single pivot at the peak point assembly by arching or bending the rafter elements. The components of the folding frame structure of the present invention can be manipulated to a manageable size and shape with fewer moving and static parts than in the known prior art. For example, the curve or bend(s) in the arch rail arrangements of FIGS. 1A, 1B allow the rafter to get wider, thus accommodating the folded leg components from a single pivot point assembly. A secondary benefit to the change in rafter shape is the change in bending moment allowing the rafter to also carry higher loads increasing the strength of the building structure itself. A tertiary benefit is to allow easier handling and lifting of the rib assembly by providing better clearance to secure and hold the assembly. The amount of bending and/or final shape, keeping in mind the foregoing objectives and advantages, can be decided by the skilled artisan.

That is, in accordance with such preferred embodiments, the shelter frame structure 5 comprises at least two or more rib assemblies 10. Each rib assembly 10 comprises a peak joint assembly 12, a first side joint assembly 14 and a second side joint assembly 16. Preferably, the peak joint assembly 12, the first side joint assembly 14 and the second side joint assembly 16 are all at least essentially identical in construction. As will be understood, shelter structure 5 will also comprises a plurality of purlin arrangements to couple the successively positioned rib assemblies to one another to thereby form shelter structure 5. Preferably, each of the rib assemblies 10 comprises a non-linear first arch rail arrangement 18 intermediate the peak joint assembly 12 and the first side joint assembly 14; a non-linear second arch rail arrangement 20 intermediate the peak joint assembly 12 and the second side joint assembly 16, a first leg arrangement 22 coupled to the first side joint assembly 14; and a second leg arrangement 24 coupled to the second side joint assembly 16. By "non-linear" it is meant that from end to end (i.e. when viewed across the entire length of the rail arrangement), is not one continuous linear or otherwise long linear bar/pole. For example, FIG. 1A illustrates curved arch rail arrangements, while FIG. 1B illustrates a plurality of straight segments formed into overall non-linear rail arrangements 18, 20. That is, arrangements 18, 20 in FIG. 1B still meets the definition of a "non-linear" arch rail arrangement as claimed. In this way, and as illustrated in the respective folded states of FIGS. 1A, 1B, the first and second leg arrangements 22, 24 are parallelly alignable and positioned intermediate the first arch rail arrangement 18 and the second arch rail arrangement 20. Moreover, the parallel alignment of the leg arrangements 22, 24 in FIGS. 1A and 1B can be achieved without the need for a double pivot joint and thus has the advantages described herein.

It will be noted that each of the peak joint assembly 12, the first side joint assembly 14 and the second side joint assembly 16 has a respective receptacle, the function and purpose thereof which will be disclosed in further detail below. Advantageously, each of the rib assemblies as illustrated in FIGS. 1A, 1B can function as an end rib assembly or an intermediate rib assembly. Receptacles on one or both sides can therefore be provided as would be understood in the art. Such receptacles may be provided by way of attachment to the joint assemblies or the legs by welding, rivets and/or screws. Receptacles as disclosed herein have been found to be much easier to use in connection with the disclosed purlin arrangements and for constructing shelter structures such as those disclosed herein, and provide for a much quicker set up and disassembly than such connection joints in the prior art, yet still provide sufficient structural integrity.

Reference is now also made to FIGS. 2-9 for a more complete disclosure and understanding of other features and preferred embodiments of the present invention. Most broadly speaking, FIGS. 9A, 9B illustrate an erectable shelter frame structure, generally indicated at 5, with three (3) rib assemblies, but this is by way of example only. In preferred embodiments, the minimum number of rib assemblies is two (2), while in a practical embodiment, the maximum number of rib assemblies is five (5).

Thus, generally speaking, in accordance with a first embodiment, the shelter frame structure 5 comprises N rib assemblies. For exemplary and disclosure purposes, N is equal to three (3). Based thereon, shelter frame structure 5 comprises at least a first rib assembly 10 and a second rib assembly 50. It should be understood that different rib assemblies are provided with differing reference numbers but this is for ease of disclosure only, as each rib assembly is preferably functionally identical with all other rib assemblies. Each rib assembly comprises a peak joint assembly, generally indicated at 12, a first side joint assembly, generally indicated at 14, and a second side joint assembly, generally indicated at 16, a first arch rail arrangement 18 intermediate the peak joint assembly 12 and the first side joint assembly 14, a second arch rail arrangement 20 intermediate the peak joint assembly 12 and the second side joint assembly 16, a first leg arrangement 22 coupled to the first side joint assembly 14, and a second leg arrangement 24 coupled to the second side joint assembly 16.

In preferred embodiments, the arch rail arrangements and/or leg arrangements may be comprised of one or more components that are coupled together, for example as disclosed in U.S. Pat. No. 7,296,584, the details of which are incorporated by reference for its disclosure of such arch rail and cross rail assemblies that can be used with the present invention. That is, one or more segmented sections may comprise each and/or any of the rail assemblies. Similarly, the leg arrangements may be comprised of segmented bars/poles, or may be telescoping, as would be understood in the art.

First, and with respect to the first end rib assembly 10, the peak joint assembly 12 comprises a receptacle 26 for receiving a first end 28A of a first purlin arrangement 28, the first side joint assembly 14 comprises a receptacle 30 for receiving a first end 32A of a second purlin arrangement 32, and the second side joint assembly 16 comprises a receptacle 34 for receiving a first end 36A of a third purlin arrangement 36.

With respect to the second rib assembly 50, the peak joint assembly 12 comprises at least a receptacle 38 in facing alignment with the peak joint receptacle 26 of the first end rib assembly 10 that receives the first end 28A of the first purlin arrangement 28, for receiving a second end 28B of the first purlin arrangement 28; the first side joint assembly 14 comprises at least a receptacle 40 in facing alignment with the first side joint receptacle 30 of the first rib assembly 10 that receives the first end 32A of the second purlin arrangement 32, for receiving a second end 32B of the second purlin arrangement 32; and the second side joint assembly 16 comprises at least a receptacle 42 in facing alignment with the second side joint receptacle 34 of the first rib assembly 10 that receives the first end 36A of the third purlin arrangement 36, for receiving a second end 36B of the third purlin arrangement 36.

Again, although each rib assembly may be provided with a different reference number and the receptacles are referenced with different reference numbers, all rib assemblies and all receptacles are preferably identically constructed.

As illustrated in FIG. 6, the erectable shelter frame structure comprises three rib assemblies. In such an example, "N" still equals two (2). Thus, in such an example comprising at least an $(N+1)^{th}$ rib assembly (i.e. a $3^{rd}$ rib assembly) 60, the peak joint assembly 12 of the $N^{th}$ rib assembly 50 further comprises a receptacle 44 for receiving a first end 46A of an N+2 purlin arrangement 46, the first side joint assembly 14 of the $N^{th}$ (i.e. second) rib assembly 50 further comprises a receptacle 48 for receiving a first end 52A of an N+3 purlin arrangement 52, and the second side joint assembly 16 of the $N^{th}$ (i.e. $3^{rd}$) rib assembly 50 further comprises a receptacle 54 for receiving a first end 56A of an N+4 purlin arrangement 56.

It should be understood that the end ribs are preferably identically constructed (i.e. receptacles on only one side thereof), while the intermediate ribs will have receptacles on each side.

The $(N+1)^{th}$ rib assembly 60 preferably comprises:

a peak joint assembly 12, a first side joint assembly 14 and a second side joint assembly 16; and a first arch rail arrangement 18 intermediate the peak joint assembly 12 and the first side joint assembly 14; a second arch rail arrangement 20 intermediate the peak joint assembly 12 and the second side joint assembly 16, a first leg arrangement 22 coupled to the first side joint assembly 14, and a second leg arrangement 24 coupled to the second side joint assembly 16; and the peak joint assembly 12 comprises a receptacle 58 in facing alignment with the peak joint receptacle of the $N^{th}$ rib assembly 50 that receives the first end 46A of the N+2 purlin arrangement 46, for receiving a second end 46B of the N+2 purlin arrangement 46;

the first side joint assembly 14 comprises a receptacle 62 in facing alignment with the first side joint receptacle 48 of the Nth rib assembly 50 that receives the first end 52 of the N+3 purlin arrangement 52, for receiving a second end 52B of the N+3 purlin arrangement 52, and the second side joint assembly 16 comprises a receptacle 64 in facing alignment with the second side joint receptacle 54 of the Nth rib assembly 50 that receives the first end 56A of the N+3 purlin arrangement 56, for receiving a second end 56B of the N+3 purlin arrangement 56.

Likewise, for the N+1th rib assembly 60, the first arch rail arrangement 18 and the second arch rail arrangement 20 are rotatable with respect to each other about the peak joint assembly 12; the first leg arrangement 22 and the first arch rail arrangement 18 are rotatable with respect to each other about the first side joint assembly 14; and the second leg arrangement 24 and the second arch rail arrangement 20 are rotatable with respect to each other about the second side joint assembly 16.

As will now be appreciated, using the rib assemblies as disclosed herein, and in a preferred embodiment, those of a non-linear rail arrangement 20, 22 as illustrated in FIGS. 1A and 1B for example, a shelter frame structure 5 that is both easy to assemble and disassembly for the reasons noted above is achieved. Moreover, it will now be appreciated that more rib assemblies can easily be fit and incorporated into the desired shelter structure size, thereby making the structure larger or smaller as desired. More specifically, with the end rib assemblies being constructed identically, rib assemblies can be added or removed from the structure as desired by merely inserting intermediate ribs having receptacles on both sides as disclosed with respect to rib assembly 50.

That is, in such preferred embodiments, each of the rib assemblies comprise non-linear first arch rail arrangements 18 (as illustrated in each of FIGS. 1A and 1B) intermediate the respective peak joint assemblies 12 and the first side joint assemblies 14; non-linear second arch rail arrangements 20 (also as illustrated in each of FIGS. 1A and 1B) intermediate the respective peak joint assemblies 12 and the second side joint assemblies 14, first leg arrangements 22 coupled to the respective first side joint assemblies 14, and second leg arrangements 24 coupled to the respective second side joint assembly 16. In this way, and as illustrated in the respective folded states of FIGS. 1A, 1B, the first and second leg arrangements 22, 24 are parallelly alignable and positioned intermediate the first arch rail arrangement 18 and the second arch rail arrangement 20, thus making for a much improved constructable, storable and erected structure for the reasons noted above.

Reference is now made specifically to FIGS. 10-13 to highlight yet another feature of the present invention, being the utilization and incorporation of toggle clamps, as further disclosed herein. More specifically, each of the peak joint assembly 12, first side joint assembly 14, and second side joint assembly 16 will comprise a respective joint toggle clamp, generally indicated at 100.

That is, with reference to the aforementioned embodiments, reference had been to peak joint assembly 12, first side joint assembly 14 and second side joint assembly 16. As defined herein, each such assembly 12, 14, 16 comprises a toggle clamp 100. The term "assembly" in this regard is thus also used to convey that the receptacles disclosed herein may be deemed part of the respective peak joint, first side joint and second side joint "assembly." For example, peak joint assembly 12 comprises a toggle clamp 100 and receptacle 26. All assemblies 12, 14, 16 are equally constructed.

As further set forth above, the shelter frame structure 5 comprises a plurality of purlin arrangements 28, 32, 36 to couple the first rib assembly 10 to the Nth rib assembly 50 to thereby form a shelter structure. Preferably, at least the first side joint toggle clamp 100 and the second side joint toggle clamp 100 are at least essentially identical in construction; and wherein each of the rib assemblies 10, 50 comprise a first arch rail arrangement 18 intermediate the peak joint toggle clamp 100 and the first side joint toggle clamp 100, a second arch rail arrangement 20 intermediate the peak joint toggle clamp 100 and the second side joint toggle clamp 100, a first leg arrangement 22 coupled to the first side joint toggle clamp 100, and a second leg arrangement 24 coupled to the second side joint toggle clamp 100.

The functioning and operation of the disclosed toggle clamps 100 will be appreciated by those skilled in the art, but for completeness the following is provided. The preferred toggle clamp of the present invention operates thorough a linkage system of levers 130, 140 and pivots. The fixed-length levers 130, 140, connected by pivot pins (see FIGS.

13A, 13B, 13C), supply the action and clamping force. Toggle action has an over-center lock position (FIG. 13C) which is a fixed stop and linkage. Once in the over-center position, the clamp 100 cannot move or unlock unless the linkage is moved. The amount of over-center travel to produce maximum holding force and yet ensure positive locking is calculated for the particular shelter strictures and would be well within the purview of one skilled in the art and therefore omitted herein.

Importantly however, the toggle clamps 100 of the present invention provide an important function. For example, and not limitation, during disassembly of the structure 5, a user may wish to release the latches on each of a particular side joint assemblies (e.g. releasing each of the toggle clamps 100 on each side joint assemblies 14 (e.g. see FIGS. 7, 8). Such may be deemed the "unlatched but locked position," an "unlocked but over-center position" or the like (see FIG. 13B). However, because of the over-center position, the entire assembly will not collapse when the toggle clamp is in the "unlatched but locked position" until an additional force is exerted on the lever 140 to move the levers to the "unclamped" position (e.g. FIG. 13A). In this way, a controlled "collapsing" of the structure 5 can be maintained with minimal effort and with minimal persons assisting. That is, each of the leg arrangements 22 can be folded in a controlled manner. Leg arrangements 24 in FIG. 7 are illustrated in a somewhat collapsed position. For the avoidance of doubt, the sequence of disassembly would preferably include the steps of placing all of the toggle clamps on one side of the structure in an "unlatched but locked position" and then slowly placing each clamp in the unclamped position to control the collapse of the structure on one side (e.g. the side with leg arrangements 22 in FIG. 7). The same sequence would be performed for the leg arrangements on the other side of the structure (e.g. leg arrangements 24 of FIG. 7) so that each of the leg arrangements 24 can be folded in a controlled manner.

In a preferred embodiment, the first side joint toggle clamp 100 and the second side joint toggle clamp 100 each respectively comprise a first arm 110 and a second arm 120 rotatably coupled to the first arm 100; a linkage assembly comprising a first lever 130 comprising a first end 132 and a second end 134, wherein the first end 132 is pivotably coupled to first arm 110; a second lever 140 comprising a first end 142 and a second end 145, wherein the first end 142 is pivotably coupled to second arm 120; and wherein the second end 134 of the first lever 130 is pivotably coupled to the second lever 140 intermediate the first end 142 and second end 145. The toggle clamps 100 each also comprise a latch 150, rotatably coupled to the second lever 140, for latching the second lever in a locking engagement relative to first lever 130. In this way, in an unclamped position, the respective rib assembly will collapse under its respective own weight or that of the shelter structure generally and in an unlatched but over-center position, the respective rib assemblies will maintain the integrity of an erected shelter frame structure until a force acts upon the structure or the toggle clamp(s) so as to collapse it/them under its/their own weight. The amount of force needed would be understood by those skilled in the art.

Figure 11:
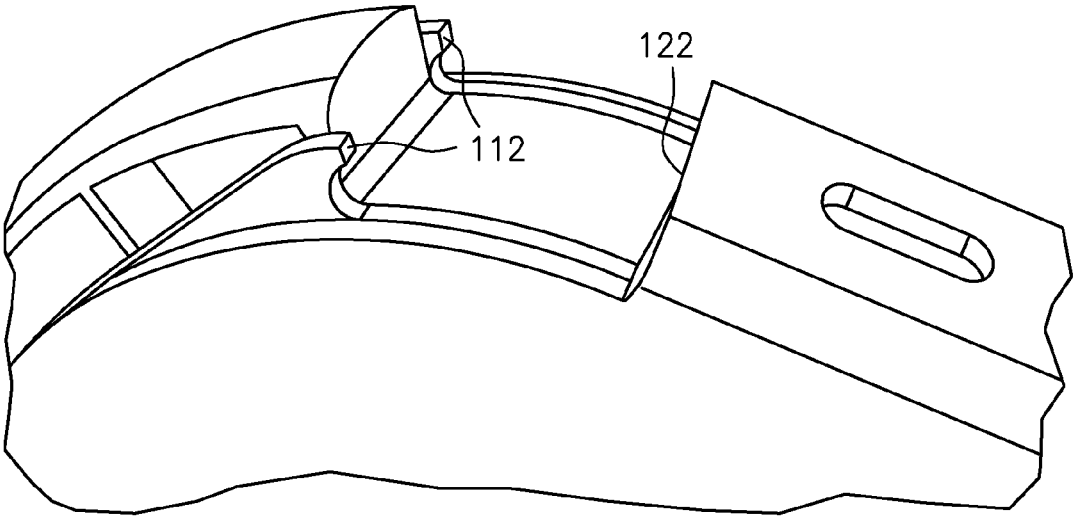
Figure 13A:
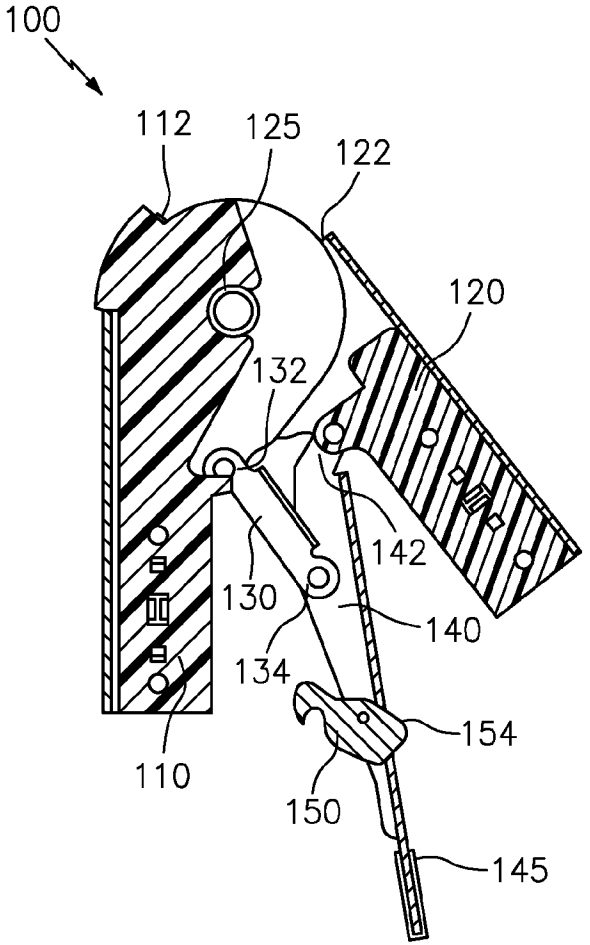
FIGS. 13A, 13B, 13C illustrate the toggle clamp of FIG. 10 shown in an "unclamped"/"unlocked," "unlocked/unlatched over-center position" and "locked" position, respectively.
Figure 13B:
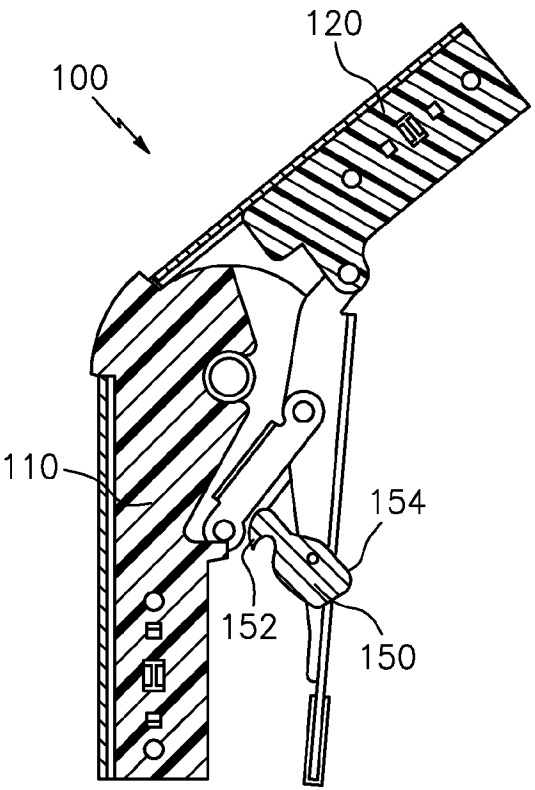
Figure 13C:
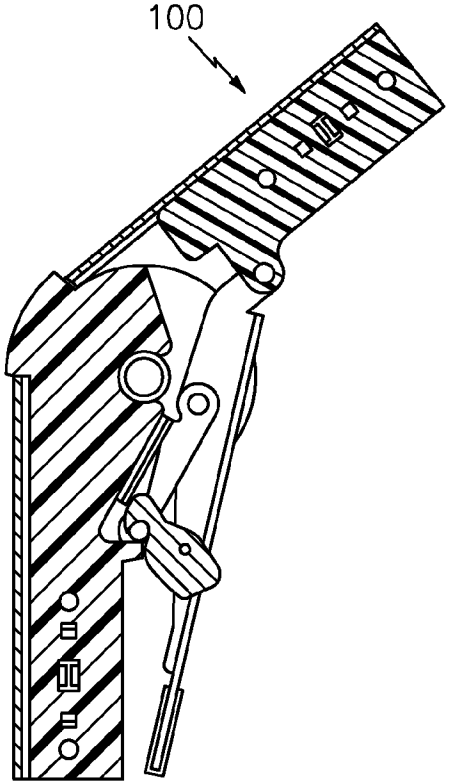

As illustrated in FIG. 11, each toggle clamp preferably comprises a shoulder 112 against which a rear edge 122 of the second arm 120 abuts to prevent an over-rotation of the second arm 120 relative to the first arm 100 when in the over-center position. To unlatch the toggle clamp, the latch 150 has a rear end 154, the pressing of which causes the latch 152 to disengage from the pivot pin 131 (see FIG. 12).

It can thus be seen that the present invention provides for improved shelter structure constructions and methods of assembly and disassembly thereof. For example, the present invention provides an improved rib assembly that provides folding elements at or near the peak of the structure and at or near the eave bends of the structure, allowing the rib structure to be folded for storage and providing for less time to erect and dismantle. The present invention also provides for a larger shelter structure than hereto provided. The present invention also provides for improved methods of construction of the shelter structure, and provides an improved rib assembly configuration that reduces the weight and construction costs thereof, while also improving the structural integrity and ease of construction and disassembly thereof.

It should also be understood that while the preferred embodiments disclosed above are made with respect to rib assemblies comprising three (3) joint assemblies, the present invention is also applicable to rib assemblies and thus shelter structures having more than three (3) joint assemblies, i.e. preferably four (4) joint assemblies. The claims are drafted consistent therewith.

It shall be understood that although the foregoing and the claims indicated a preferred sequence of steps, the exact sequence of steps is not material to the present invention and the claims should not be construed to present a specific sequence or order of steps unless explicitly stated that the sequence must be performed in a particular order. For the avoidance of doubt, as originally filed, no such particular order is being claimed.

It should also be understood that the ends of arms 110 and 120 of toggle clamps 100 may be of a cross-sectional shape (i.e. rounded) to accommodate and be received in the ends of the arch rail arrangements and leg arrangements, respectively. The ends of the arms 110, 120 of the toggle clamps 100 may then be coupled to the ends of the arch arrangements and/or leg arrangements by friction fit, welding, riveting, screwing or the like and/or a combination thereof to secure them together. Similarly, if desired, the ends of the arch rail arrangements and leg arrangements could be shaped and dimensioned to be received inside the ends 110, 120 of the toggle clamps if so desired or needed.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall therebetween.

What is claimed is:

1. An erectable shelter frame structure comprising:

at least a first rib assembly and an Nth rib assembly, wherein each of the first rib assembly and the Nth rib assembly comprises:

a peak joint assembly, a first side joint assembly and a second side joint assembly, a first arch rail arrangement intermediate the peak joint assembly and the first side joint assembly, a second arch rail arrangement intermediate the peak joint assembly and the second side joint assembly, a first leg arrangement coupled to the first side joint assembly, and a second leg arrangement coupled to the second side joint assembly, wherein with respect to the first end rib assembly:

the peak joint assembly comprises a receptacle for receiving a first end of a first purlin arrangement, the first side joint assembly comprises a receptacle for receiving a first end of a second purlin arrangement, and the second side joint assembly comprises a receptacle for receiving a first end of a third purlin arrangement, wherein with respect to the Nth rib assembly:

the peak joint assembly comprises a receptacle in facing alignment with the peak joint assembly receptacle of the first rib assembly that receives the first end of the first purlin arrangement, for receiving a second end of the first purlin arrangement; the first side joint assembly comprises at least a receptacle in facing alignment with the first side joint assembly receptacle of the first rib assembly that receives the first end of the second purlin arrangement, for receiving a second end of the second purlin arrangement; and the second side joint assembly comprises a receptacle in facing alignment with the second side joint assembly receptacle of the first rib assembly that receives the first end of the third purlin arrangement, for receiving a second end of the third purlin arrangement;

wherein for each of the first end rib assembly and the Nth rib assemblies, the first arch rail arrangement and the second arch rail arrangement are rotatable with respect to each other about the respective peak joint assemblies, the first leg arrangement and the first arch rail arrangement are rotatable with respect to each other about the respective first side joint assemblies, and the second leg arrangement and the second arch rail arrangement are rotatable with respect to each other about the respective second side joint assemblies; and wherein each of the first rib assembly and the Nth rib assembly comprises a peak joint toggle clamp, a first side joint toggle clamp and a second side joint toggle clamp and wherein at least the first side joint toggle clamp and the second side joint toggle clamp are at least essentially identical in construction; and wherein the first side joint toggle clamp and the second side joint toggle clamp each respectively comprise:

a first arm and a second arm rotatably coupled to the first arm;

a linkage assembly comprising:

a first lever comprising a first end and a second end, wherein the first end is pivotably coupled to the first arm;

a second lever comprising a first end and a second end, wherein the first end is pivotably coupled to the second arm; and wherein the second end of the first lever is pivotably coupled to the second lever intermediate the first end and second end of the second lever;

a latch, rotatably coupled to the second lever, for latching the second lever in a locking engagement relative to first lever;

wherein in an unclamped position, the respective rib assembly will collapse under its own weight or that of the shelter structure and in an unlatched but over-center position, the respective rib assembly will maintain the integrity of the shelter frame structure.

2. The erectable shelter frame structure as claimed in claim 1, comprising at least an $(N+1)^{th}$ rib assembly, wherein in the erectable shelter frame structure comprising an $(N+1)^{th}$ rib assembly:

the peak joint assembly of the $N^{th}$ rib further comprises a receptacle for receiving a first end of an N+2 purlin arrangement, the first side joint assembly of the $N^{th}$ rib further comprises a receptacle for receiving a first end of an N+3 purlin arrangement, and the second side joint assembly of the $N^{th}$ rib further comprises a receptacle for receiving a first end of an N+4 purlin arrangement, and wherein the $(N+1)^{th}$ rib assembly comprises:

a peak joint assembly, a first side joint assembly and a second side joint assembly; and a first arch rail arrangement intermediate the peak joint assembly and the first side joint assembly; a second arch rail arrangement intermediate the peak joint assembly and the second side joint assembly, a first leg arrangement coupled to the first side joint assembly, and a second leg arrangement coupled to the second side joint assembly; and the peak joint assembly comprises a receptacle in facing alignment with the peak joint assembly receptacle of the $N^{th}$ rib assembly that receives the first end of the N+2 purlin arrangement, for receiving a second end of the N+2 purlin arrangement;

the first side joint assembly comprises a receptacle in facing alignment with the first side joint assembly receptacle of the Nth rib assembly that receives the first end of the N+3 purlin arrangement, for receiving a second end of the N+3 purlin arrangement, and the second side joint assembly comprises a receptacle in facing alignment with the second side joint assembly receptacle of the Nth rib assembly that receives the first end of the N+3 purlin arrangement, for receiving a second end of the N+3 purlin arrangement, wherein for the $(N+1)^{th}$ rib assembly:

the first arch rail arrangement and the second arch rail arrangement are rotatable with respect to each other about the peak joint assembly; the first leg arrangement and the first arch rail arrangement are rotatable with respect to each other about the first side joint assembly; and the second leg arrangement and the second arch rail arrangement are rotatable with respect to each other about the second side joint assembly.

3. The erectable shelter frame structure as claimed in claim 2, where N is an integer equal to two (2).

4. The erectable shelter frame structure as claimed in claim 1, where N is an integer equal to two (2).

5. An erectable shelter frame structure comprising:

a first rib assembly and at least a second rib assembly, wherein each of the first rib assembly and the second rib assembly comprises a peak joint assembly, a first side joint assembly and a second side joint assembly, and wherein the peak joint assembly, the first side joint assembly and the second side joint assembly are all at least essentially identical in construction;

a plurality of purlin arrangements to couple the first rib assembly to the second rib assembly and thereby form a shelter structure;

wherein each of the first and second rib assemblies comprises:

a non-linear first arch rail arrangement intermediate the peak joint assembly and the first side joint assembly;

a non-linear second arch rail arrangement intermediate the peak joint assembly and the second side joint assembly, a first leg arrangement coupled to the first side joint assembly, and a second leg arrangement coupled to the second side joint assembly; and each of the first rib assembly and second rib assembly are foldable such that in a folded state:

the first and second leg arrangements of each respective first rib assembly and second rib assembly are parallely aligned and positioned intermediate the first arch rail arrangement and the second arch rail arrangement; and wherein each of the first rib assembly and the second rib assembly comprises a peak joint toggle clamp, a first side joint toggle clamp and a second side joint toggle clamp and wherein at least the first side joint toggle clamp and the second side joint toggle clamp are at least essentially identical in construction; and wherein the first side joint toggle clamp and the second side joint toggle clamp each respectively comprise:

a first arm and a second arm rotatably coupled to the first arm:

a linkage assembly comprising:

a first lever comprising a first end and a second end. wherein the first end is pivotably coupled to the first arm;

a second lever comprising a first end and a second end, wherein the first end is pivotably coupled to the second arm; and wherein the second end of the first lever is pivotably coupled to the second lever intermediate the first end and second end of the second lever;

a latch, rotatably coupled to the second lever, for latching the second lever in a locking engagement relative to first lever;

wherein in an unclamped position, the respective rib assembly will collapse under its own weight or that of the shelter structure and in an unlatched but over-center position, the respective rib assembly will maintain the integrity of the shelter frame structure.

6. An erectable shelter frame structure comprising:

at least a first rib assembly and an Nth rib assembly, wherein each of the first rib assembly and the Nth rib assembly comprises a peak joint toggle clamp, a first side joint toggle clamp and a second side joint toggle clamp;

a plurality of purlin arrangements to couple the first rib assembly to the Nth rib assembly to thereby form a shelter structure;

wherein at least the first side joint toggle clamp and the second side joint toggle clamp are at least essentially identical in construction; and wherein each of the rib assemblies comprise a first arch rail arrangement intermediate the peak joint toggle clamp and the first side joint toggle clamp, a second arch rail arrangement intermediate the peak joint toggle clamp and the second side joint toggle clamp, a first leg arrangement coupled to the first side joint toggle clamp, and a second leg arrangement coupled to the second side joint toggle clamp;

wherein the first side joint toggle clamp and the second side joint toggle clamp each respectively comprise:

a first arm and a second arm rotatably coupled to the first arm;

a linkage assembly comprising:

a first lever comprising a first end and a second end, wherein the first end is pivotably coupled to the first arm;

a second lever comprising a first end and a second end, wherein the first end is pivotably coupled to the second arm; and wherein the second end of the first lever is pivotably coupled to the second lever intermediate the first end and second end of the second lever;

a latch, rotatably coupled to the second lever, for latching the second lever in a locking engagement relative to first lever;

wherein in an unclamped position, the respective rib assembly will collapse under its own weight or that of the shelter structure and in an unlatched but over-center position, the respective rib assembly will maintain the integrity of the shelter frame structure.

7. The erectable shelter frame structure as claimed in claim 6, wherein N is an integer equal to two (2) or three (3).

8. The erectable shelter frame structure as claimed in claim 6, wherein the first and second side joint toggle clamps each respectively comprise a shoulder against which a rear edge of the second arm abuts to prevent an over rotation of the second arm relative to the first arm.

9. The erectable shelter frame structure as claimed in claim 8, wherein the latch has a rear end, the pressing of which causes the latch to disengage from the first lever.

* * * * *